US007101106B1

(12) United States Patent
Wiley

(10) Patent No.: US 7,101,106 B1
(45) Date of Patent: Sep. 5, 2006

(54) ROTARY DISPENSER WITH EXTENDED HANDLE FOR CREAM, LOTION, GEL OR LIQUID

(76) Inventor: Lien L. Wiley, 2164 Brownstone Creek Ave., Simi Valley, CA (US) 93063

( * ) Notice: Subject to any disclaimer, the term of this patent is extended or adjusted under 35 U.S.C. 154(b) by 320 days.

(21) Appl. No.: 10/817,251

(22) Filed: Apr. 3, 2004

Related U.S. Application Data

(60) Provisional application No. 60/461,764, filed on Apr. 11, 2003.

(51) Int. Cl.
*B43K 7/02* (2006.01)

(52) U.S. Cl. ..... 401/210; 41/208; 41/219; 41/205; 41/21

(58) Field of Classification Search ..... 401/21, 401/208, 210, 216, 219, 220, 263, 270, 281, 401/204, 205, 183
See application file for complete search history.

(56) References Cited

U.S. PATENT DOCUMENTS

| | | | | | |
|---|---|---|---|---|---|
| 2,029,056 | A * | 1/1936 | Carlson | ..... | 401/208 |
| 4,150,904 | A * | 4/1979 | Stewart | ..... | 401/186 |
| 5,051,016 | A * | 9/1991 | Bengston | ..... | 401/213 |
| 6,126,352 | A * | 10/2000 | Wiley | ..... | 401/208 |

* cited by examiner

*Primary Examiner*—Huyen Le
(74) *Attorney, Agent, or Firm*—Allen A. Dicke, Jr.

(57) ABSTRACT

The dispenser has a rotary dispenser roller mounted on a reservoir with a telescoping handle. The dispensing head preferably has a valve in its supply channel to control and stop dispensing of cream, lotion, gel or liquid fluids for application to the body surfaces. The dispensing head is angled to conveniently apply fluids to most body surfaces. The dispensing head may carry tools thereon for working with the dispensed fluids.

18 Claims, 7 Drawing Sheets

ROTARY DISPENSER WITH EXTENDED HANDLE FOR CREAM, LOTION, GEL OR LIQUID

CROSS-REFERENCE

This application relies upon Provisional Application Ser. No. 60/461,764, filed Apr. 11, 2003, for priority.

FIELD OF THE INVENTION

This invention is directed to a dispenser for the dispensing of fluid material, particularly fluid materials for application to the body surface, with the dispenser having an extended handle for hard-to-reach surfaces such as on the users back.

BACKGROUND OF THE INVENTION

Body lotions, creams and other fluids are often applied by simple dispensing from a container onto the user's hands, and then the user distributes it over the body. The fluid material is applied to the body, as required, in accordance with the character of the fluid material and its function.

It is desirable to have an improved system wherein a rotary dispenser applies the fluid material to the surface. In addition, in order to aid in the distribution of the fluid over parts of the body which are more difficult to reach, an extended handle is provided. Thus, improved distribution is achieved.

BRIEF SUMMARY OF THE INVENTION

In order to aid in the understanding of this invention, it can be stated in essentially summary form that it is directed to an improved rotary dispenser with extended handle for the external body application of body-treating fluid materials including cream, lotion, gel and liquid.

It is, thus, a purpose and advantage of this invention to provide an improved rotary dispenser for dispensing body-treating fluids to the external surface of the human It is a further purpose and advantage of this invention to provide a dispenser structure which includes a reservoir and an extended handle on the reservoir so that the fluid in the reservoir for body application can be more readily applied to all body surfaces.

It is another purpose and advantage of this invention to provide various valves which are configured to control the flow of the fluid from the reservoir.

It is another purpose and advantage of this invention to provide rotary structures, such as rollers in roller baskets in order to properly distribute the fluid onto the body surface.

It is another purpose and advantage of this invention to provide a roller head which carries thereon other implements to aid in distribution of fluid onto the body surface at any location on the body.

These and other purposes and advantages of this invention will become apparent from a study of the following portion of the specification taken in conjunction with the accompanying drawings.

DESCRIPTION OF THE PREFERRED EMBODIMENTS

Figure 1:
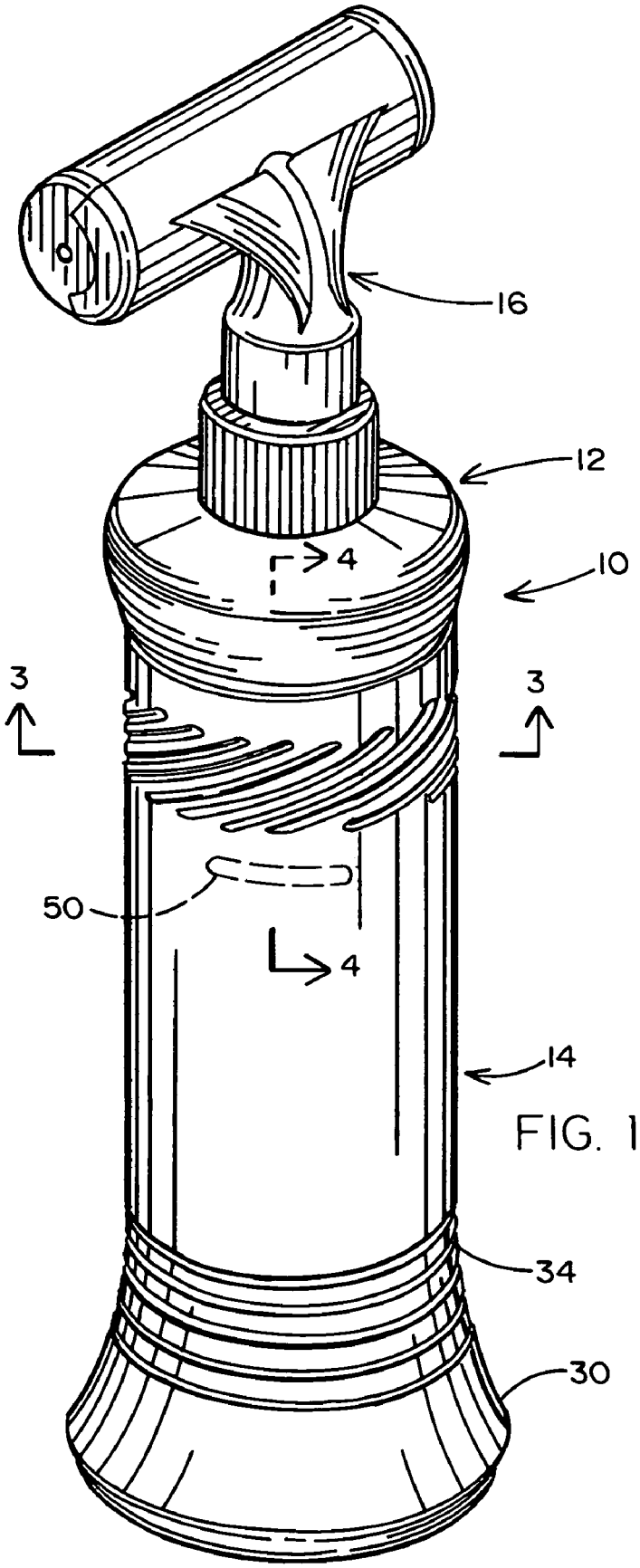
FIG. 1 is an isometric view of the preferred embodiment of the improved rotary dispenser with extended handle, in accordance with this invention.

The dispenser for dispensing fluids including cream, lotion, gel or liquid is generally indicated at 10 in FIG. 1. The dispenser 10 has three principal parts: reservoir 12 for containing the fluid; extended handle 14 for extending the length of the dispenser; and roller head 16 mounted on the top of the reservoir for providing the control of flow and distribution of the fluid onto the body surface. The fluid is a cosmetic or medically active fluid for human dermatological or topological use.

The reservoir 12 is preferably a hollow polymer structure such as a blow-molded bottle. Its side walls 18 are principally in the form of a tubular right circular cylinder. It has a closed bottom 20, which is integrally formed with the sidewalls. The top of the reservoir has a radially outward extending shoulder 22. The shoulder carries top 24 and the top carries spout 26. The spout has exterior threads 28 upon which a rotary dispenser can be threadedly attached and sealed.

The extension handle 14 is also made of a synthetic polymer composition structure. Its upper portion is a right circular cylindrical tube. It may have a flare 30 toward its bottom. The flare provides a wider base to increase stability when the dispenser 10 is standing on the bottom 32 of the extension handle. On its exterior, toward the top of the flare, the handle has ribs 34 which extend all the way around the rotary handle. These ribs are to aid in secure grasp of the extension handle.

Figure 2:
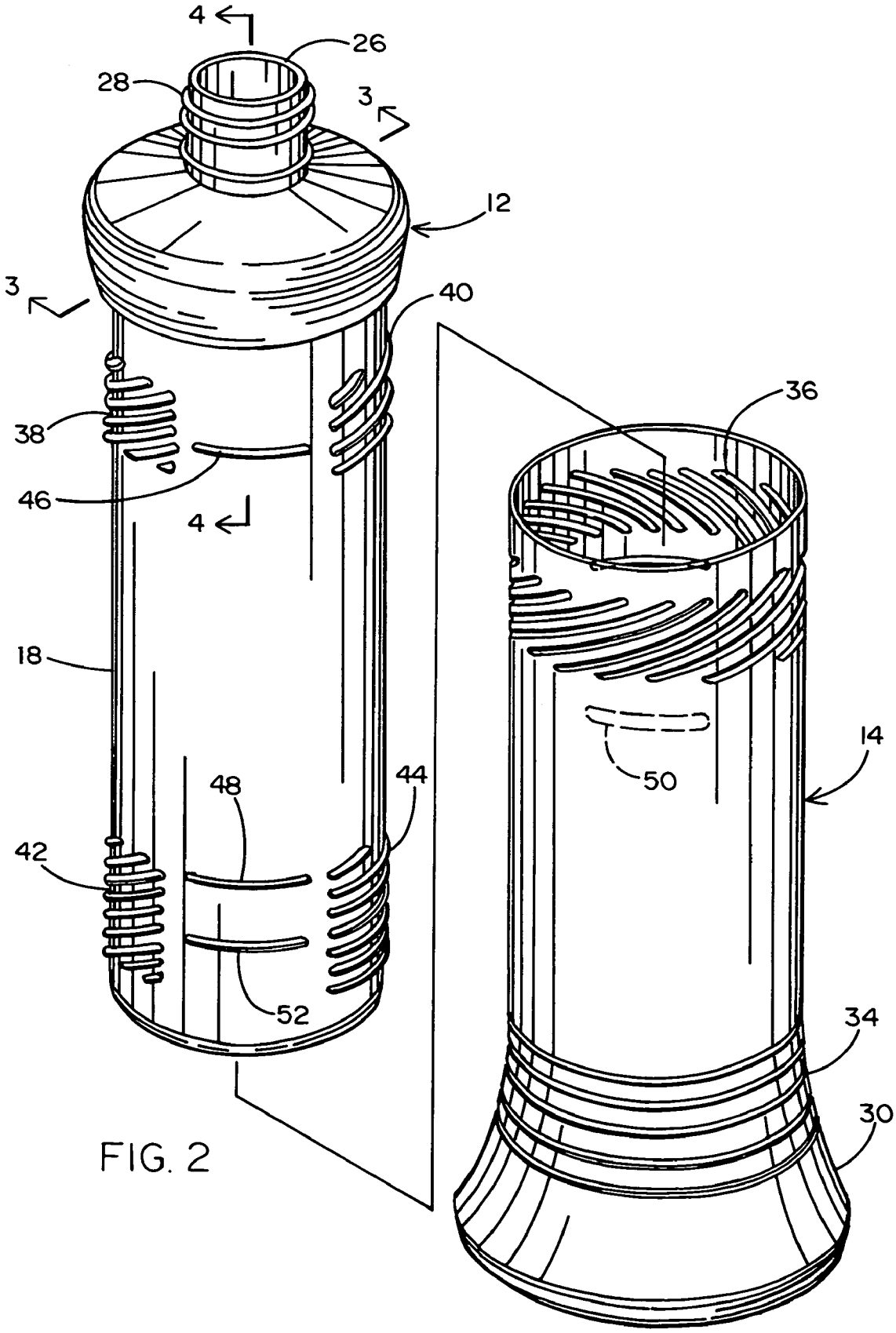
FIG. 2 is an exploded view showing the reservoir and the extended handle in exploded position.

Interengagement between the reservoir 12 and handle 14 is provided in the form of threads 46, which are formed on the interior of the handle near its top, see FIG. 2. The threads are highly angular and are multiple start threads. The axial length of the threads and the pitch of the threads is such that they can be disengaged in about a quarter turn of the extension handle 14 with respect to reservoir 12. The interior surface of the threads has a sliding fit with respect to the sidewalls 18 of the reservoir.

Figure 3:
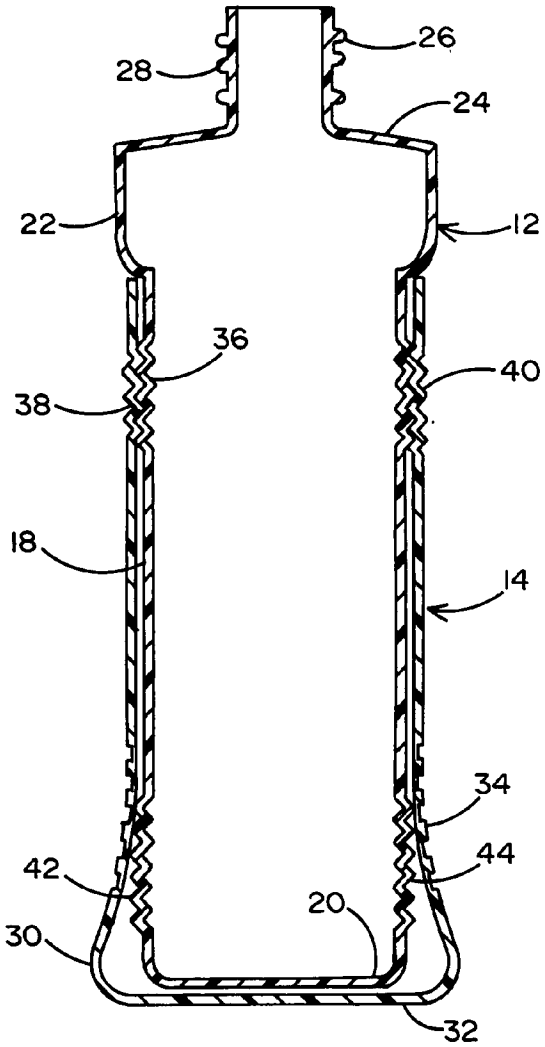
FIG. 3 is a section through the reservoir and extended handle on a central axial plane.
Figure 5:
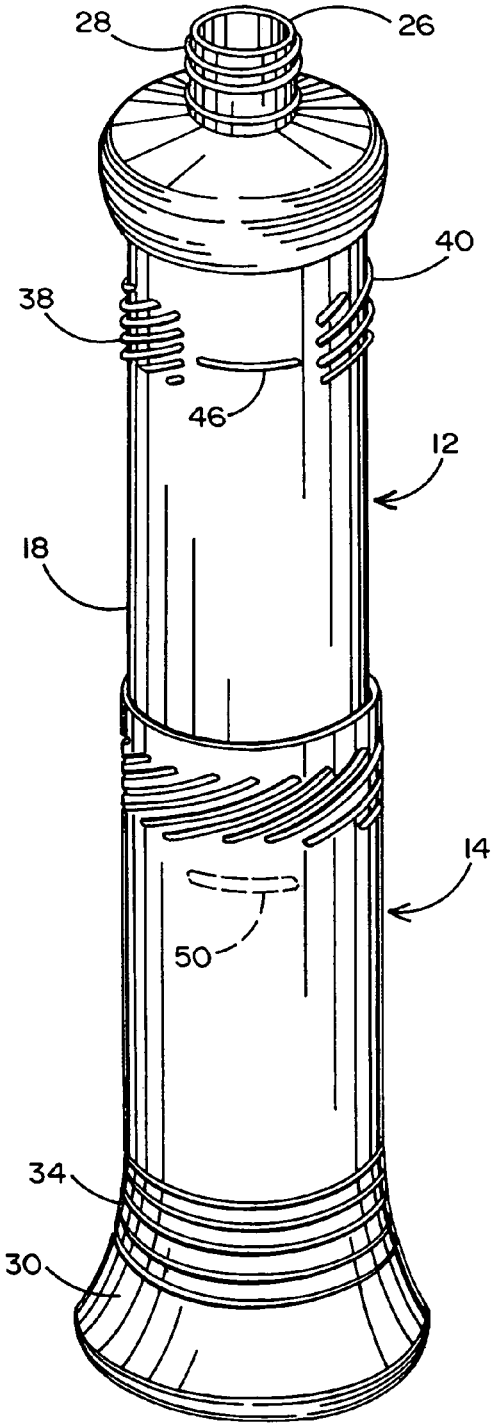
FIG. 5 is a view similar to FIG. 1, but showing the handle extended.

Reservoir 18 has corresponding threads, but on the reservoir, the threads are in interrupted sections. FIGS. 2 and 5 show sections 38 and 40 of upper interrupted threads. There may be two or three such thread sections around the circumference of the reservoir. Two is a sufficient number and is shown. The threads sections 38 and 40 are sized to threadedly engage with the threads 36. Thus, when the extension handle 14 is in the raised position on reservoir 12 as shown in FIGS. 1 and 3, the threads are engaged to hold the extension handle in place.

The reservoir 12 also has lower thread sections 42 and 44 thereon. These are the same as thread sections 38 and 40, but are placed adjacent the bottom of the reservoir. This structure permits the threads 36 to be unscrewed with respect to the thread sections 38 and 40 by clockwise rotation of the extension handle looking down with respect to the reservoir. The extension handle is then pulled down and rotated so that the threads 36 engage with the lower thread sections 42 and 44. The handle is, thus, in the extended position shown in FIG. 5.

Figure 4:
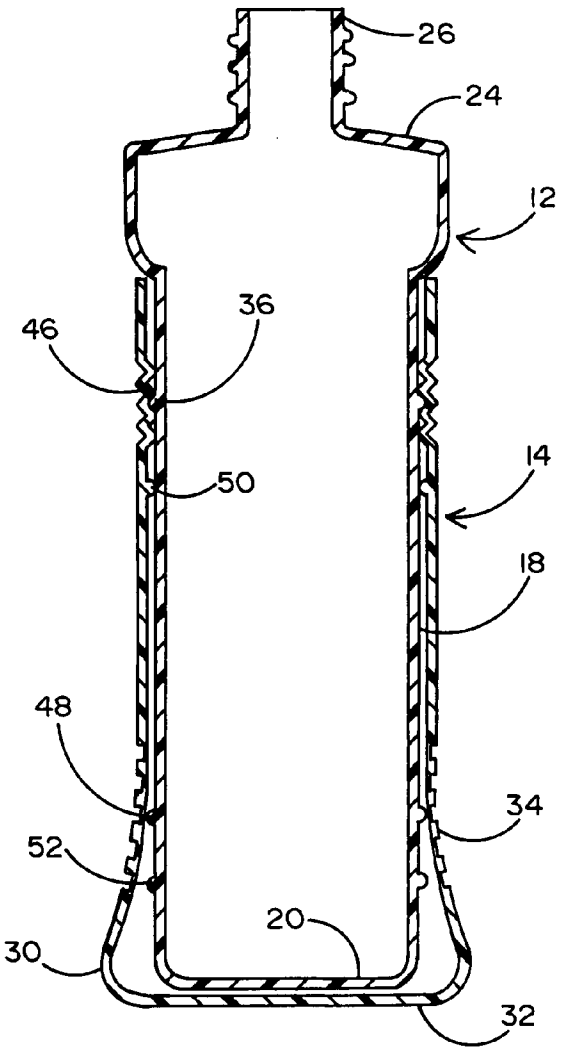
FIG. 4 is a similar section on a plane at a right angle with respect to the plane of FIG. 3.

In order to control the extension handle with respect to the reservoir, upper detent 46 and lower detent 48 are provided on the exterior of the reservoir. These are engaged by extension handle detent 50 seen in full lines in FIG. 4. The extension handle detent is also shown in dashed lines in FIGS. 1, 2 and 5 because it is on the inside of the extension handle. These detents are sized and shaped so that they releasably retain the extension handle with respect to the reservoir. In addition, the reservoir carries a stop 52 which is higher than the detents 46 and 48. It is sufficiently high that it stops the extension handle from being unscrewed off of the bottom of the reservoir. In this way, the extension handle is maintained in place. The structure provides a reservoir/handle combination which can be employed to carry dermatological fluids to the skin. The handle lengthens the structure so that the disposition can be easily accomplished and hard-to-reach areas such as on the users back.

The preferred embodiment of the rotary dispensing head is generally indicated at 16 in FIGS. 6, 9, 10 and 11. The dispensing head has a mounting body 54, which has an internally threaded collar 56. The internally threaded collar 56 may be integrally formed with the mounting body or may be a separate collar which rotates thereon. The collar threads onto the spout 26 and engages on threads 28. The mounting body thus is sealed against the spout to avoid the loss of fluid. The mounting body has a neck 58 thereon. Roller carrier basket 60 is mounted on the neck. There is an interior passage 62 through the neck which terminates in the basket 60, see FIGS. 6 and 11. Fluid product can be delivered up the passage 62 from the reservoir into the roller carrier basket. Channel 64 intersects passage 62 to extend substantially the interior length of the roller basket. The depth and width of the channel is dependent upon the viscosity of the fluid which is to be dispensed and distributed. More viscous fluid requires larger channels.

The ends of the roller basket terminate in walls 66 and 68. Within the end walls are pivot pin slots, one of which is seen at 70 in FIG. 11. There is a pair of these slots, one on the inside of each inner wall. The slots are directed down into the basket in the direction of the channel 64 and passage 62.

Figure 10:
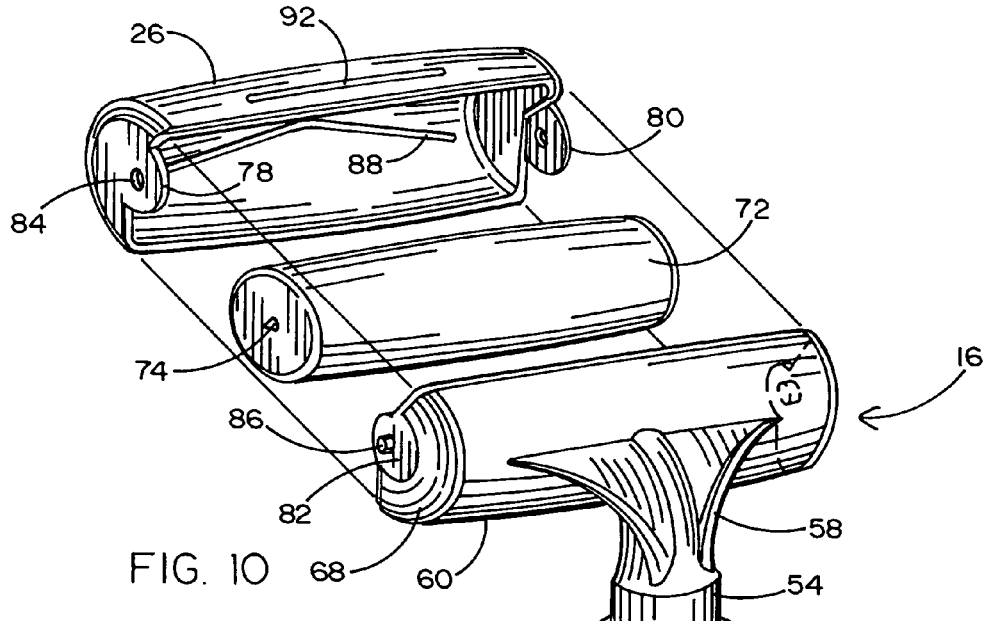
FIG. 10 is a similar view of the dispensing head, shown in the exploded position.
Figure 11:
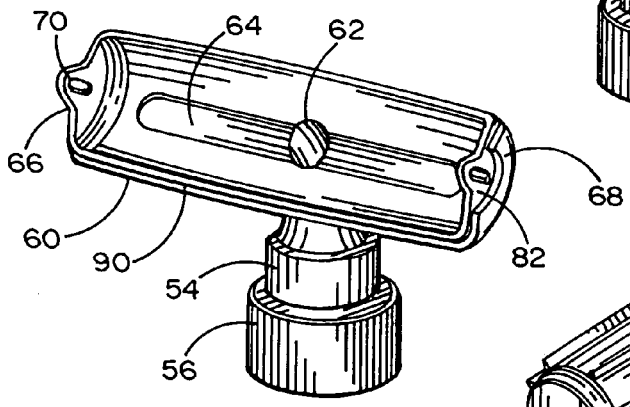
FIG. 11 shows the basket of the dispensing head, with the parts separated.

Roller 72 is sized to fit into the basket 60. Roller 72 is of any convenient material which is wetted by the fluid. The roller has a pivot pin on each end. Pivot pin 74 is in FIG. 10. There is a similar pivot pin on the opposite end. The pivot pins engage in the slots, of which slot 70 is an example. The roller 72 can move toward and away from the passage 62 by virtue of the direction of the slots. When the roller is pressed toward the passage 62, it closes off the channel 64 and passage 62. Roller 72 is not cylindrical, but is in the general curve so that it is of larger diameter at the center than at the ends. It is an oblate spheroid truncated at both ends. The structure is such that, when fluid is dispensed from the passage 62 into channel 64, it is distributed onto the back of the roller. Then, when the roller is pressed against the skin and the dispenser 10 is moved, the roller rotates to distribute the fluid onto the skin. In order to provide maximum roller area accessible to touch to the skin, the sides of the basket are below a plane through the pivot pins on the roller. As is best seen in FIG. 11, the sides of the basket are below the rotational axis of the roller.

Cover 76 is sized to fit over the roller 72. It has ears 78 and 80 which slip into corresponding recesses in the end of the basket. Recess 82 is seen in FIGS. 10 and 11. Furthermore, the ears have holes therein, such as hole 84 in ear 78. These holes snap over the projections in the recess, such as projection 86 in recess 82. This permits the cover to snap on and off of the basket. The cover is sized so that its internal ribs 88 engage on roller 72. Thus, when the cover is in place, the roller 72 is pushed down over channel 64 to close the channel. This prevents evaporation and hardening of the fluid material. In order to enhance the seal, there is an overlapping step 90 around the edge of the basket and a corresponding step in the cover. These steps interengage when the cover is in place to maintain the alignment of the cover. The cover can be snapped off by engagement on ridge 92.

Figure 12:
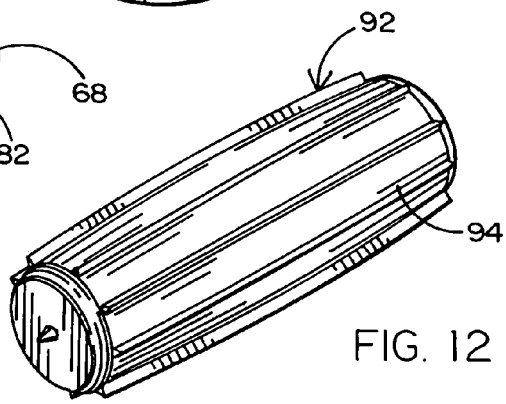
FIG. 12 is a perspective view of a ribbed dispensing roller.
Figure 13:
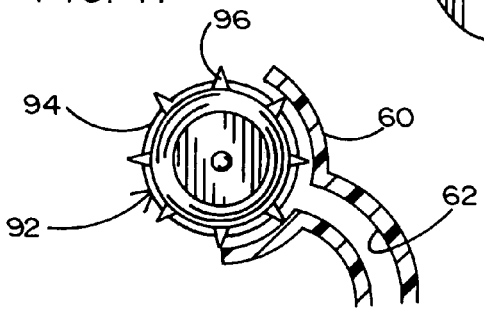
FIG. 13 is a transverse section through the dispensing head showing the roller of FIG. 12 therein.

The roller 72 is a moderately hard and rigid roller, which is wettable by the fluid being distributed. An alternative roller 92, shown in FIGS. 12 and 13, is of somewhat different construction and is more suitable for body application fluids of lighter viscosity. It has a fairly firm interior and has a cover 94 thereon of elastomeric material. The cover is provided with ribs 96, which sweep through the roller carrier basket 60. The ribs both seal the passage 62 when the roller is not rotating and permit the distribution of fluids of higher viscosity when the dispenser is in use and the roller is being rolled on the skin for the deposition of skin care products thereon.

Figure 6:
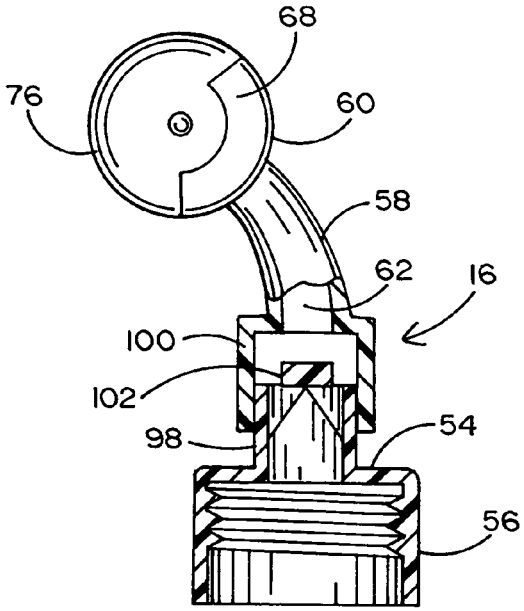
FIG. 6 is a side view through the dispensing head showing a first valve for controlling the flow of fluid from the reservoir into the dispensing head.
Figure 9:
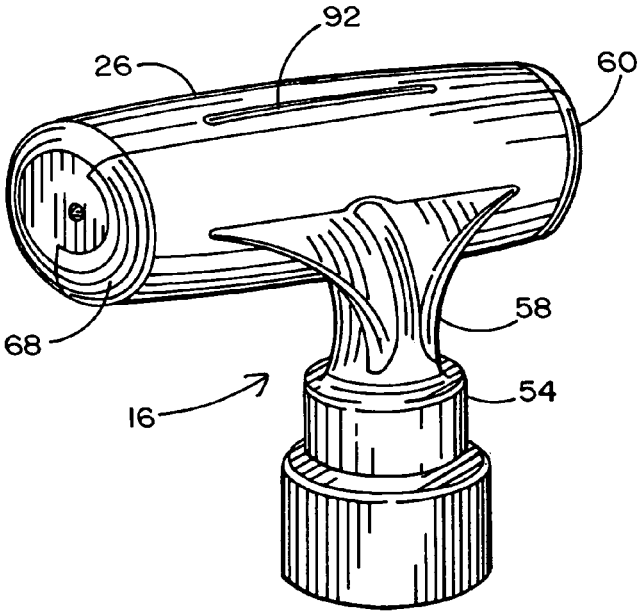
FIG. 9 is a perspective view of the dispensing head.

Control of the outflow of fluid from the reservoir can be accomplished by pressing the roller back into its basket. For fluids of lighter viscosity, it may be helpful to have an additional valve which closes fluid flow. FIG. 6 shows a boss 98 which is formed of part of the mounting body 54. Collar 100 slides on boss 98. Plug 102 is carried on webs within the boss 98. When the neck 98 is raised to the open position shown in FIG. 6, the plug is away from the passage 62. When the collar is pressed down, the plug 102 enters the passage 62 to plug the passage and close off flow. The neck can be raised again to the position shown for restoration of flow. Suitable detents are provided to limit the motion in collar 100 on boss 98 to functional limits.

Figure 7:
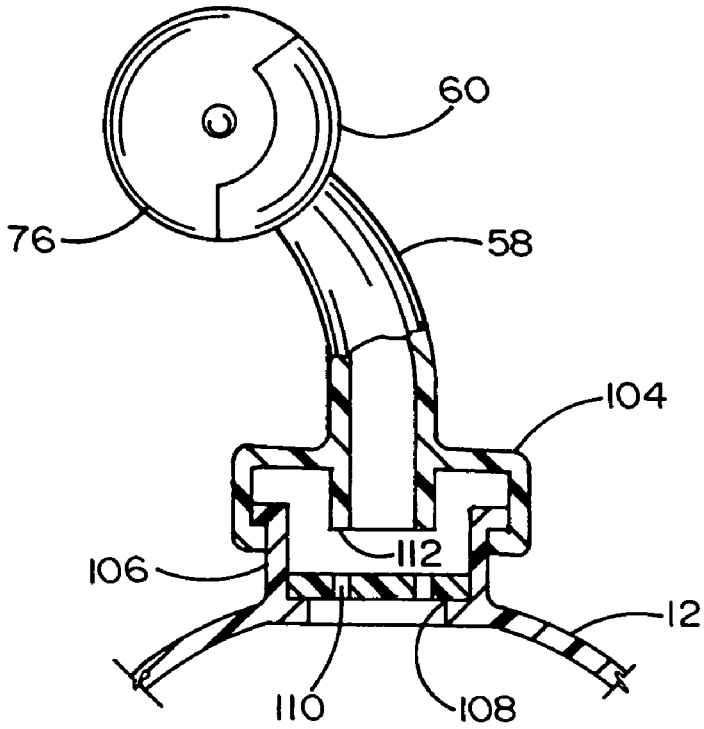
FIG. 7 is a view similar to FIG. 6, showing a second embodiment of the valve.

FIG. 7 shows a valve dispenser head wherein the collar 104 engages around the neck 106 on the reservoir 12. The neck contains a disc 108 which has a plurality of fluid passages 110 therein. When the roller basket is in the raised position shown, the fluid passages 110 are uncovered. When a roller basket is pressed down, the circular nose 112 covers all of the fluid passages 110. The neck and roller-carrying basket can be raised to the position shown to permit flow and can be lowered so that the nose 112 covers the fluid passages 110 to prevent flow. Valving is thus achieved by up and down motion of the roller basket with respect to the reservoir.

Figure 8:
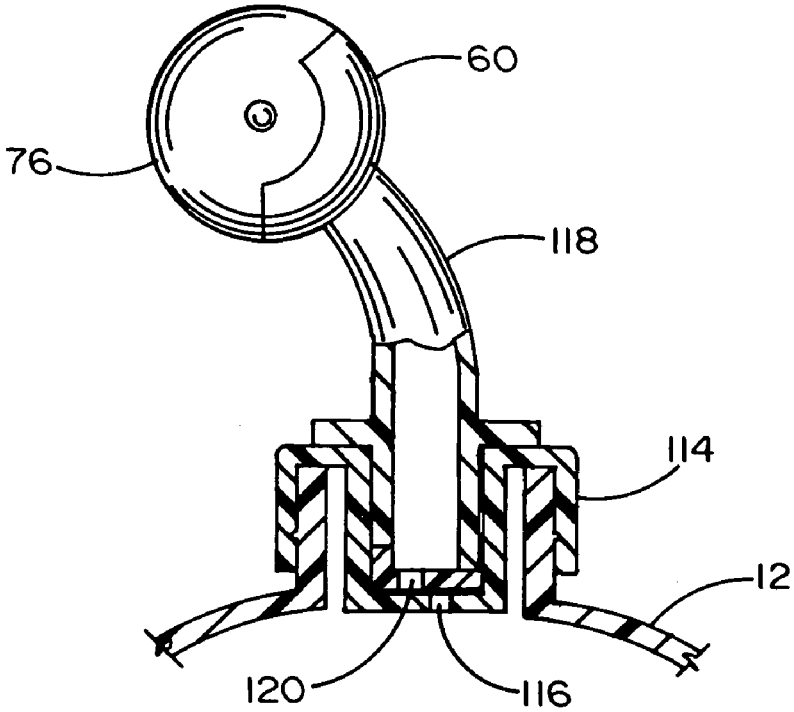
FIG. 8 is a view similar to FIG. 6 showing a third embodiment of the valve.

FIG. 8 shows a cup 104 attached onto the neck of the reservoir. Attachment can be by snap-on fit with detent, as shown. On the other hand cup may have screw threads thereon to permit threaded attachment to the reservoir. The bottom of the cup has an eccentric hole 116. The neck 118 extends down into the cup and contains an eccentric hole 120. When the dispensing head is in the position shown, the eccentric holes are out of alignment and, thus, the valve is shut. When the roller carrier basket and its neck are rotated 180 degrees from the position shown in FIG. 8, the holes are in alignment so that fluid products can be dispensed from the reservoir into the roller carrier basket. The upper structure of the dispenser is the same as that described with respect to FIGS. 9 through 11.

Figure 14:
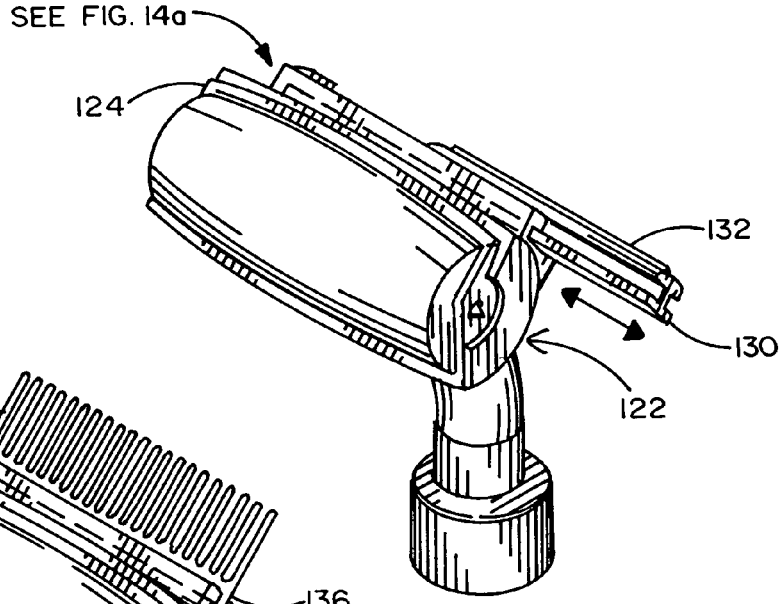
FIG. 14 is a perspective view of the dispensing head of FIG. 9, shown from the roller side and shown with a razor-mounting structure removably mounted in a mounting slot.
Figure 15:
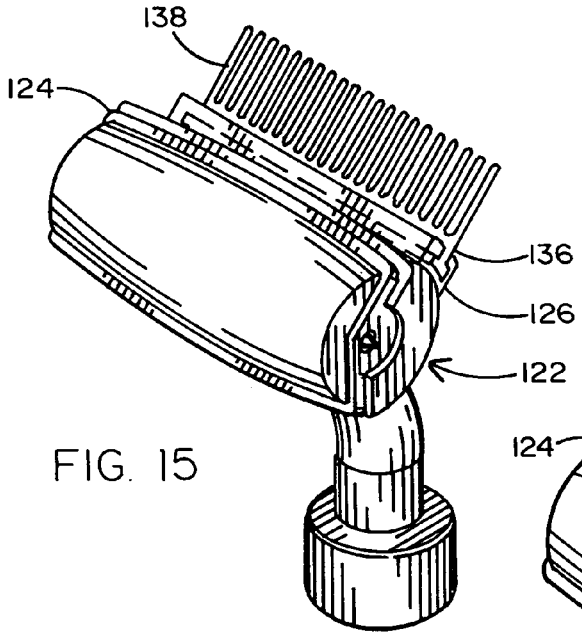
FIG. 15 is a view similar to FIG. 14 showing a comb removably installed in the mounting slot.
Figure 16:
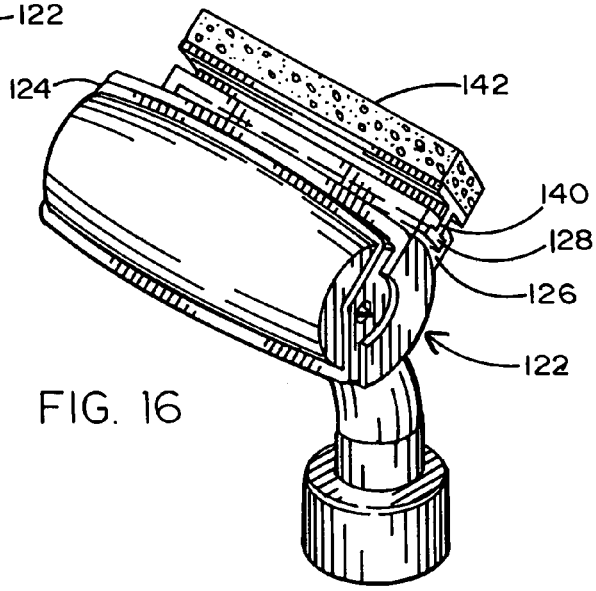
FIG. 16 is a view similar to FIG. 14, showing a sponge and a sponge carrier mounted in the mounting slot.
Figure 14A:
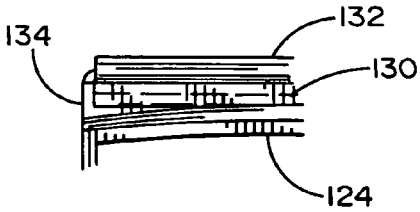
FIG. 14*a* shows an end-stop detail in the slot receiving the razor blade carrier.

The dispenser head 122, shown in FIGS. 14, 15 and 16 is the same as the dispensing head 16 and has the same roller mounting and cover structure. It may have any of the valves of FIGS. 6,7 and 8. The roller carrier basket is seen at 124. The difference in this structure is that a bar 126 having a T-slot 128 therein is mounted on the outside of the basket. The T-slot is configured to receive a T-bar. In FIG. 14, T-bar 130 carries razorblade 132. FIG. 14*a* shows a stop 134 at the end of the T-slot to limit entry motion of the T-bar into the T-slot. In FIG. 15, the T-bar 136 carries comb 138. In FIG. 16, T-bar 140 carries sponge 142. One of these instruments can be inserted into the T-slot for use immediately after the application of fluid to the skin. For example, the dispenser of FIG. 14 can dispense lubricant to aid in shaving, and the dispensing head is then turned around in the hand. Shaving is in proportion with the razorblade 132. Similarly, material can be applied to the hair by the dispensing head of FIG. 15. Thereupon, the comb 138 is used to comb the material into the hair. The fluid material dispensed in this case can be a hair conditioning or coloring agent.

With respect to the structure of FIG. 16, a fluid cleansing material can be dispensed by the dispensing head and applied by the roller. Immediately after dispensing, the sponge 142 can be applied to rub the fluid material into the skin. Thus, dispensing and distributing fluid material onto the skin can be achieved and thereafter followed with sponging.

This invention has been described in its presently preferred embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A dispenser for dispensing fluid for body application comprising:

a reservoir, said reservoir having an outer surface which is a right circular cylinder about an axis, said outer surface having an upper end and a lower end, interrupted screw threads formed on said surface adjacent said upper end and interrupted screw threads formed on said surface adjacent said lower end;

a tubular extension handle, said tubular extension handle being sized to surround said reservoir and said threads thereon, said extension handle having interior threads thereon sized to engage said interrupted threads adjacent said upper end and said interrupted threads adjacent said lower end of said reservoir surface, said threads being positioned so that when said threads within said extension handle engage on said interrupted threads on the exterior surface adjacent the upper end of said reservoir, said handle is unextended on said reservoir and when said threads in said extension handle engage on said interrupted threads on the surface of said reservoir adjacent its lower end, said handle is extended.

2. The dispenser for dispensing fluid of claim 1 wherein said reservoir has stop ridges on said exterior surface of said reservoir adjacent its lower end and said extension handle has an interior stop ridge thereon adjacent its interior threads so that said extension handle is stopped from being unthreaded off the bottom of said reservoir.

3. The dispenser for dispensing fluid of claim 2 wherein said stop ridge is a first ridge and there are also first and second detent ridges on the exterior surface of said reservoir, said first and second detent ridges being positioned adjacent the interruption of said threads adjacent the top of said surface of said reservoir and adjacent said bottom of said surface of said reservoir.

4. The dispenser for dispensing fluid of claim 1 wherein said reservoir has a spout and a dispenser is attached to said spout, said dispenser having a neck and a roller carrier basket on said neck, a passage from said reservoir through said spout and through said neck to said roller basket, said roller basket having end walls;

a roller in said roller basket, said roller having pivot structure thereon and said roller basket having pivot structure thereon in said end walls so that said roller is pivoted to roll in said roller basket.

5. The dispenser for dispensing fluid of claim 4 wherein said pivot structure between said roller and said roller basket includes a slot in said pivot structure to permit said roller to move toward and away from said fluid passage so that urging said roller toward said fluid passage closes off said fluid passage to inhibit fluid flow.

6. The dispenser for dispensing fluid of claim 5 wherein there is a cover, said cover being sized to engage over said roller and attach onto said roller basket, to thrust said roller toward said fluid passage.

7. The dispenser for dispensing fluid of claim 6 wherein said roller pivot structure comprises pivot pins on the ends of said roller and slots in said roller basket.

8. The dispenser for dispensing fluid of claim 7 wherein said end walls of said roller basket have projections therein and said cap engages over said projections to releasibly retain said cap on said roller basket.

9. The dispenser for dispensing fluid of claim 4 wherein said dispensing basket has an open side in which the roller is disposed, said roller basket having its open side directed at an angle of about 135 degrees with respect to the axis of said reservoir.

10. The dispenser for dispensing fluid in accordance with claim 4 further including a valve in said passage between said reservoir and said roller basket so that the flow of fluid from said reservoir to said roller basket can be controlled.

11. A dispenser for dispensing fluid for body application, comprising:

a reservoir for containing fluid for body application, an extension handle on said reservoir, said reservoir having an axis, said extension handle being movable from a first position where it is unextended with respect to said reservoir and to a second position where it is extended with respect to said reservoir, an outlet on said reservoir;

a fluid dispenser on said outlet to receive fluid from said reservoir, said fluid dispenser having a neck and having a roller basket thereon, a passage from said reservoir through said neck to said roller basket to permit fluid to flow from said reservoir to said roller basket, said neck being rotatable around said axis of said reservoir, said reservoir having an opening on one side of said axis and said neck having an opening on the other side of said axis so that when said neck is rotated to a first position, said openings are out of alignment with each other and flow is inhibited and when said neck is rotated to a second position, said openings are in alignment to permit fluid flow from said reservoir into said passage; and a roller in said roller basket, said roller being positioned to receive fluid from said passage, said roller being rotatable in said roller basket so that said roller can be drawn over the skin to rotate and apply fluid to the skin.

12. The dispenser for dispensing fluid in accordance with claim 11 wherein said passage opens into said roller basket and there is a channel in said roller basket, said channel being connected to said passage, said roller having a rotational axis which defines its length, said roller being an oblate spheroid which is truncated at both of its axial ends, said roller being elongated along its axis and said channel being directed along said roller axis so that said channel delivers fluid to said roller along its length.

13. The dispenser for dispensing fluid of claim 12 wherein said roller is retained in said roller basket by means of rotational attachment structures on its axis and said basket is open in a circumferential direction around said axis at least 225 degrees.

14. The dispenser for dispensing fluid in accordance with claim 12 wherein said roller basket has a step around its edge and there is a cap, said cap being configured to engage on said step and to press said roller toward said passage and toward said channel so that said roller is covered and said passage and said channel are restricted.

15. The dispenser for dispensing fluid in accordance with claim 12 wherein said rotatable mounting structure for rotatively mounting said roller in said basket for rotation about said axis includes a pin on said roller and a groove in said roller basket so that said roller can move crosswise of its axis toward and away from passage in said channel.

16. A dispenser for dispensing fluid for body application, comprising:

a reservoir for containing fluid for body application, an extension handle on said reservoir, said extension handle being movable from a first position where it is unextended with respect to said reservoir and to a second position where it is extended with respect to said reservoir, an outlet on said reservoir;

a fluid dispenser on said outlet to receive fluid from said reservoir, said fluid dispenser having a neck and having a roller basket thereon, a passage from said reservoir through said neck to said roller basket, said passage being open into said roller basket to permit fluid to flow from said reservoir to said roller basket, a valve in said fluid passage to control flow of fluid through said passage, a channel in said roller basket, said channel being connected to said passage; and a roller in said roller basket, said roller being positioned to receive fluid from said passage, said roller having a rotational axis which defines its length, said roller being an oblate spheroid which is truncated at both of its axial ends, said roller being elongated along its axis and said channel being directed along said roller axis so that said channel delivers fluid to said roller along its length, said basket having a removable fluid spreading device thereon so that said roller can be drawn over the skin to rotate and apply fluid to the skin.

17. The dispenser for dispensing fluid of claim 16 wherein said fluid-spreading device is mounted in a T-slot on said basket.

18. A dispenser for dispensing fluid for body application comprising:

a reservoir, said reservoir having an outer surface which is a right circular cylinder about an axis, said outer surface having an upper end and a lower end, screw threads formed on said surface adjacent said upper end and screw threads formed on said surface adjacent said lower end, said reservoir having a spout and a dispenser attached to said spout, said dispenser having a neck;

a roller carrier basket on said neck, a passage from said reservoir through said spout and through said neck to said roller basket, said roller basket having end walls;

a roller in said roller basket, said roller having pivot structure thereon and said roller basket having pivot structure thereon, said roller pivot structure comprising pivot pins on the ends of said roller so that said roller is pivoted to roll in said roller basket, said pivot structure between said roller and said roller basket including slots in said pivot structure to permit said roller to move toward and away from said fluid passage so that urging said roller toward said fluid passage closes off said fluid passage to inhibit fluid flow;

a cover, said cover being sized to engage over said roller and attach onto said roller basket to thrust said roller toward said fluid passage, said end walls of said roller basket having projections therein and said cap engaging over said projections to releasibly retain said cap on said roller basket;

a tubular extension handle, said tubular extension handle being sized to surround said reservoir and said threads thereon, said extension handle having interior threads thereon sized to engage said interrupted threads adjacent said upper end and said interrupted threads adjacent said lower end of said reservoir surface, said threads being positioned so that when said threads within said extension handle engage on said interrupted threads on the exterior surface adjacent the upper end of said reservoir, said handle is unextended on said reservoir and when said threads in said extension handle engage on said interrupted threads on the surface of said reservoir adjacent its lower end, said handle is extended.

* * * * *